US007926922B2

(12) United States Patent
Taira et al.

(10) Patent No.: US 7,926,922 B2
(45) Date of Patent: Apr. 19, 2011

(54) INK-JET HEAD AND VALVE

(75) Inventors: Hiroshi Taira, Ichinomiya (JP); Yoshirou Kita, Nagoya (JP); Tadanobu Chikamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1041 days.

(21) Appl. No.: 11/692,460

(22) Filed: Mar. 28, 2007

(65) Prior Publication Data

US 2007/0229610 A1 Oct. 4, 2007

(30) Foreign Application Priority Data

Mar. 31, 2006 (JP) ..... 2006-097095

(51) Int. Cl.
*B41J 2/17* (2006.01)
*B41J 2/175* (2006.01)

(52) U.S. Cl. ..... 347/84; 347/85

(58) Field of Classification Search ..... 347/84, 347/85, 89; 251/149
See application file for complete search history.

(56) References Cited

U.S. PATENT DOCUMENTS

| | | | | |
|---|---|---|---|---|
| 4,520,369 | A * | 5/1985 | Shackleton | 347/85 |
| 6,217,164 | B1 | 4/2001 | Hino | |
| 2005/0157104 | A1 | 7/2005 | Hirota et al. | |

FOREIGN PATENT DOCUMENTS

| | | | |
|---|---|---|---|
| JP | S50-002959 | U | 1/1975 |
| JP | H05-077439 | A | 3/1993 |
| JP | 2000-198215 | A | 7/2000 |
| JP | 2004-268282 | A | 9/2004 |
| JP | 2005169839 | A | 6/2005 |
| JP | 2005-297577 | A | 10/2005 |

OTHER PUBLICATIONS

Japan Patent Office; Notice of Reasons for Rejection in Japanese Patent Application No. 2006-097095 (counterpart to the above-captioned U.S. patent application) mailed Mar. 30, 2010 (abridged translation).

* cited by examiner

*Primary Examiner* — Geoffrey Mruk
(74) *Attorney, Agent, or Firm* — Baker Botts L.L.P.

(57) ABSTRACT

An ink-jet head of the present invention includes a discharge valve that includes a valve chamber and an opening/closing mechanism. The valve chamber has an ink supply port through which ink is supplied from outside, an outside discharge port through which ink is discharged to outside, and a reservoir discharge port through which ink is discharged to an ink reservoir. The opening/closing mechanism is able to selectively take either one of a state where a passage is formed between the ink supply port and the outside discharge port while access between the ink supply port and the reservoir discharge port is blocked and a state where a passage is formed between the ink supply port and the reservoir discharge port while access between the ink supply port and the outside discharge port is blocked.

8 Claims, 10 Drawing Sheets

INK-JET HEAD AND VALVE

CROSS-REFERENCE TO RELATED APPLICATIONS

This application claims the benefit of Japanese Patent Application No. 2006-097095, filed Mar. 31, 2006, the disclosure of which is incorporated herein by reference.

BACKGROUND OF THE INVENTION

1. Field of the Invention

The present invention relates to an ink-jet head that eject ink droplets, and also to a valve.

2. Description of Related Art

An ink-jet printer performs printing by ejecting ink droplets to a recording medium. Known as an ink-jet head included in the ink-jet printer is one having a reservoir, a common ink chamber, and individual ink passages. The reservoir stores ink therein. Ink is supplied through the reservoir to the common ink chamber. The individual ink passages extend from the common ink chamber through pressure chambers to nozzles. In such an ink-jet head, the reservoir has an ink supply port communicating with outside, so that ink is supplied to the reservoir through an ink tube that is connected to the ink supply port.

When ink is charged into the ink-jet head, air remaining in the ink tube and in a pump which is for sending out ink may, together with ink, flow through the ink supply port into the reservoir. The air having flown into the reservoir may undesirably remain in and block the individual ink passages which are fine passages. Remaining of air bubbles or blocking of the passages cause deterioration in ink ejection performance, or ejection failure. Japanese Patent Unexamined Publication No. 2005-169839 discloses technique that provided an air discharge passage that discharges air, which has flown into a reservoir together with ink, to outside.

SUMMARY OF THE INVENTION

According to the technique disclosed in the above-mentioned document, air in the reservoir can be discharged to a certain extent. However, once air flows into an ink passage, it is difficult to completely remove the air, because the ink passage which is formed in an ink-jet head including a reservoir has a complicated shape. Alternatively, although air in the ink-jet head can be discharged, large consumption of ink is required in order to discharge air that has once entered.

An object of the present invention is to provide an ink-jet head that makes it difficult for air to flow into an ink passage when ink is charged, and also to provide a valve that is used in the ink-jet head.

According to a first aspect of the present invention, there is provided an ink-jet head including a passage unit, a reservoir unit, and a discharge valve. The passage unit includes a common ink chamber and individual ink passages each extending from the common ink chamber through a pressure chamber to a nozzle. The reservoir unit is fixed to the passage unit and includes an ink reservoir that communicates with the common ink chamber. The discharge valve includes a valve chamber and an opening/closing mechanism. The valve chamber has an ink supply port through which ink is supplied from outside, an outside discharge port through which ink is discharged to outside, and a reservoir discharge port through which ink is discharged to the ink reservoir. The opening/closing mechanism is able to selectively take either of a state where a passage is formed between the ink supply port and the outside discharge port while access between the ink supply port and the reservoir discharge port is blocked and a state where a passage is formed between the ink supply port and the reservoir discharge port while access between the ink supply port and the outside discharge port is blocked.

In the above aspect, when ink is supplied through the ink supply port of the discharge valve, a passage can be formed between the ink supply port and the outside discharge port while blocking access between the ink supply port and the reservoir discharge port, by means of the opening/closing mechanism. Accordingly, air, which remains in the valve chamber, an ink tube that is communicably connected to the ink supply port, and a pump that sends out ink to the ink tube, does not enter the reservoir through the reservoir discharge port but is discharged to outside through the outside discharge port. After the air remaining in the valve chamber, the ink tube, and the pump is fully discharged to outside, the opening/closing mechanism of the discharge valve takes a state where a passage is formed between the ink supply port and the reservoir discharge port while access between the ink supply port and the outside discharge port is blocked, so that ink is supplied to the reservoir through the reservoir discharge port. Like this, air remaining in the ink tube and the pump is discharged to outside before it flows into the ink passages of the ink-jet head. Thus, air hardly flows into the ink passages of the ink-jet head. That is, it is less likely that air blocks the individual ink passages and the like. Therefore, deterioration in ink-droplet ejection performance does not easily occur.

According to a second aspect of the present invention, there is provided a valve including a valve chamber, an opening/closing mechanism, and a support wall. The valve chamber has a supply port through which liquid is supplied from outside, and first and second discharge ports through which liquid is discharged to outside in opposite directions. The opening/closing mechanism has an elastic member disposed in the valve chamber, and a support member supporting the elastic member and being able to take a first position for making the elastic member seal the second discharge port and open the first discharge port and a second position for making the elastic member seal the first discharge port and open the second discharge port. The support wall supports the support member in such a manner that the support member penetrates through the first discharge port and is slidable in a direction perpendicular to an opening plane of the first discharge port. The support member has an inflow opening, an outflow opening, and an internal passage. The inflow opening is formed between a position of the first discharge port and a position at which the elastic member locates when the support member takes the first position. The outflow opening is formed at a position more distant from the elastic member than the inflow opening is with respect to a sliding direction of the support member. The internal passage is formed between the inflow opening and the outflow opening. When the support member takes the first position the inflow opening locates within the valve chamber and the outflow opening locates outside the valve chamber, while when the support member takes the second position the inflow opening and the outflow opening locate outside the valve chamber.

In the above aspect, through a simple operation of reciprocating the elastic member between the first and second discharge ports, the opening/closing mechanism can selectively take the state where a passage is formed between the supply port and the first discharge port while access between the supply port and the second discharge port is blocked and the state where a passage is formed between the supply port and the second discharge port while access between the supply port and the first discharge port is blocked.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a certain preferred embodiment of the present invention will be described with reference to the accompanying drawings.

Figure 1:
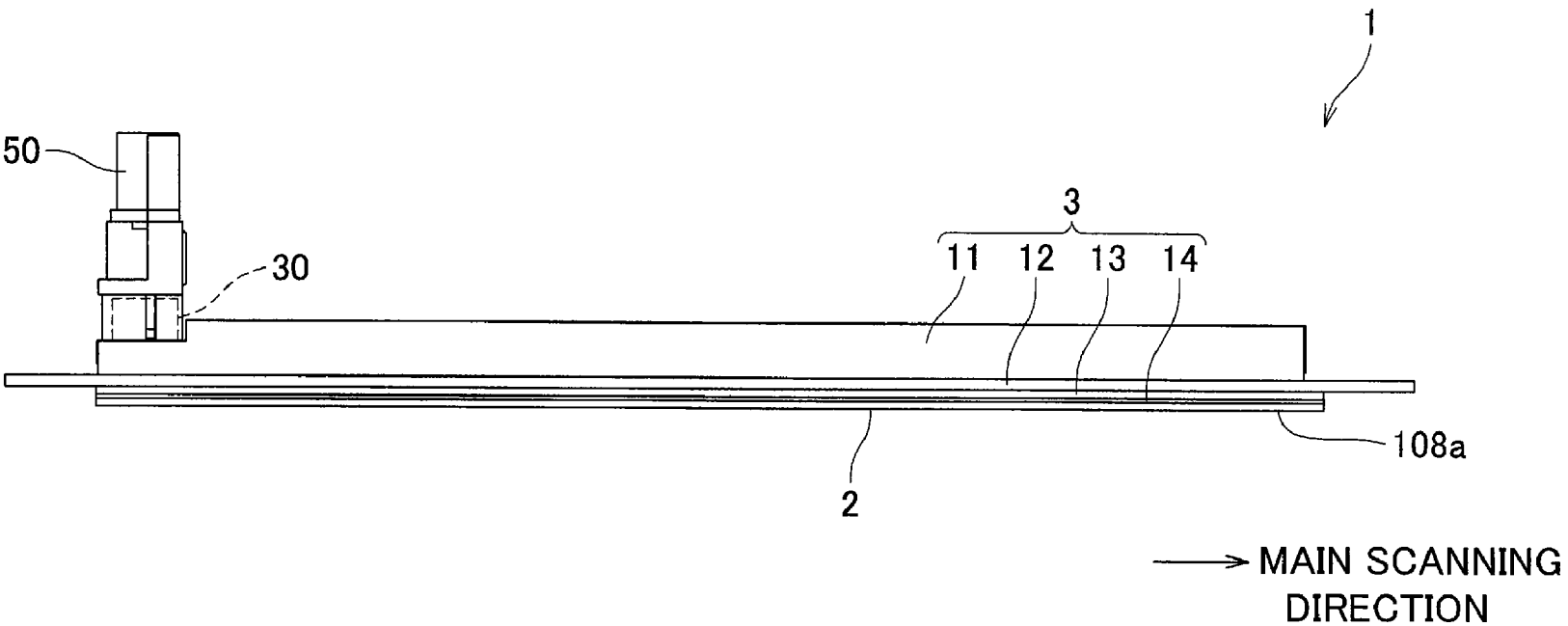
FIG. 1 is a side view showing an appearance of an ink-jet head according to an embodiment of the present invention.
Figure 2:
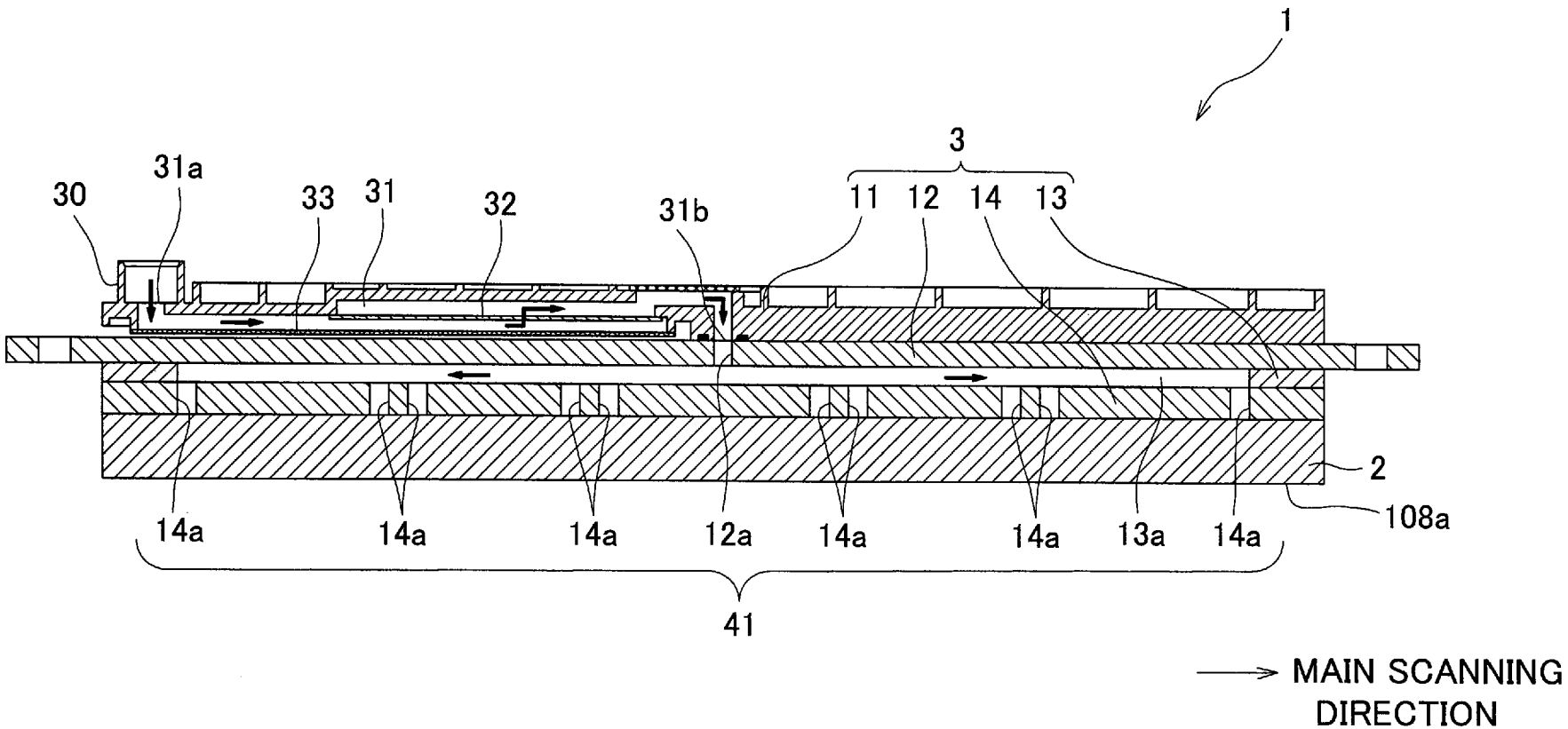
FIG. 2 is a longitudinal sectional view of the ink-jet head shown in FIG. 1.

FIG. 1 is a side view showing an appearance of an ink-jet head according to a preferred embodiment of the present invention. FIG. 2 is a sectional view of the ink-jet head 1 shown in FIG. 1, taken along a longitudinal direction, i.e., main scanning direction. For the purpose of explanatory convenience, FIG. 2 is drawn to an enlarged scale in its up-and-down direction, and besides FIG. 2 appropriately illustrates an ink passage which actually does not appear in a plane sectioned along the same line. In addition, illustration of a valve 50 is omitted. As shown in FIGS. 1 and 2, the ink-jet head 1 extends in a main scanning direction and has, from a lower side, a head main body 2, a reservoir unit 3, and a valve 50 as a discharge valve. The head main body 2 has, on its lower face, an ink ejection face 108*a* as a nozzle surface The reservoir unit 3 temporarily stores ink therein. The valve 50 is attached to the reservoir unit 3.

Figure 3:
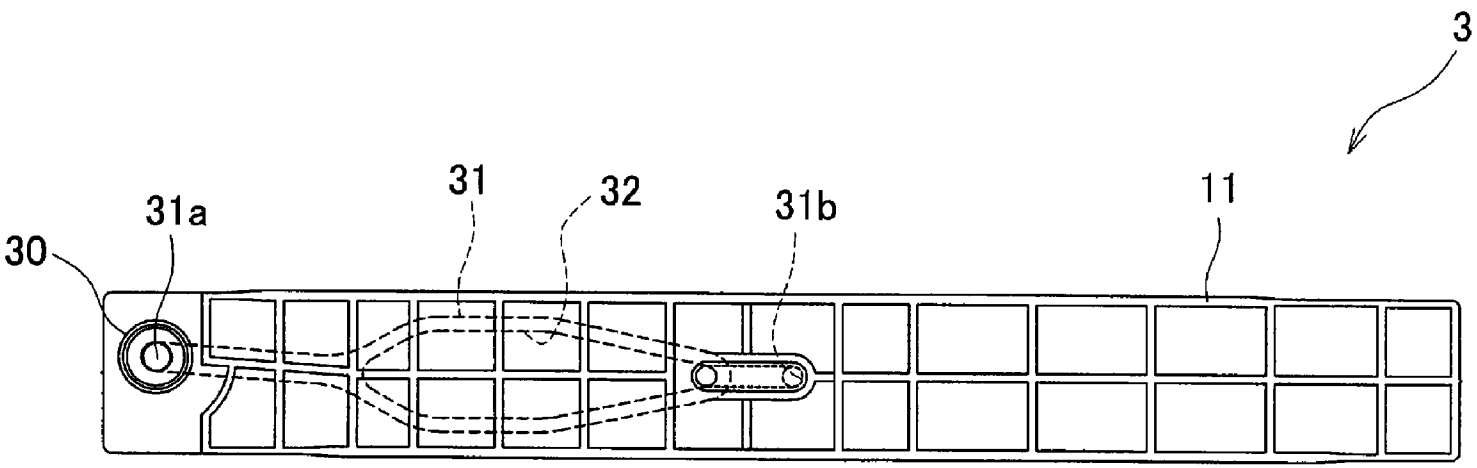
FIG. 3 is a plan view of a reservoir unit shown in FIG. 1.

The reservoir unit 3 will be described with additional reference to FIG. 3. FIG. 3 is a plan view of the reservoir unit 3 as seen from a top side thereof. As shown in FIGS. 1 to 3, the reservoir unit 3 temporarily stores ink therein, and supplies ink to a passage unit 9 (see FIGS. 5 to 7) included in the head main body 2. The reservoir unit 3 has a layered structure of a passage component 11 extending in the main scanning direction, and three plates 12 to 14 each having in a plan view a rectangular shape extending in the main scanning direction, among which the three plates 12 to 14 are metal plates made of a stainless steel or the like.

The passage component 11 is made of a synthetic resin such as a polyethylene terephthalate resin and a polypropylene resin. As shown in FIG. 2, an upper reservoir 31 as an ink reservoir is formed inside the passage component 11. The upper reservoir 31 communicates with outside through an inflow port 31*a*, and communicates with a lower reservoir 41 through an outflow port 31*b*. The inflow port 31*a* is formed on an upper face of the passage component 11, at one longitudinal end portion thereof, i.e., at left side in FIGS. 1 to 3. The outflow port 31*b* is formed on a lower face of the passage component 11, at a center thereof with respect to a longitudinal direction. The upper reservoir 31 extends from the inflow port 31*a* downward along a thickness direction of the passage component 11, and then extends along the longitudinal direction to a central portion of the passage component 11. At the central portion of the passage component 11, the upper reservoir 31 once extends upward along the thickness direction of the passage component 11, and extends downward until it reaches the outflow port 31*b*. Like this, the upper reservoir 31 is formed only in a portion of the passage component 11 between the center and the one end with respect to an extending direction of the passage component 11.

As shown in FIG. 2, a region of the upper reservoir 31 extending along the longitudinal direction of the passage component 11 is defined by a film 33 adhered to the lower face of the passage component 11. As shown in FIG. 3, the region has a substantially elliptical shape in a plan view. The film 33 extending along the longitudinal direction of the passage component 11 is disposed in opposition to the region. The film 33 is made of a flexible material having an excellent gas barrier property, such as a PET (polyethylene terephthalate) film that is vapor-deposited with a silica film (SiOx film) or an aluminum film. Accordingly, air existing outside the ink-jet head 1 can hardly enter the upper reservoir 31 through the film 33. The film 33 is flexible. Therefore, when a rapid pressure fluctuation occurs in the upper reservoir 31, the film 33 functions as a damper that absorbs the pressure fluctuation.

A reservoir-side joint 30 connected to the inflow port 31*a* is formed on the upper face of the passage component 11. The reservoir-side joint 30 has a valve 50 connected thereto as shown in FIG. 1, and has a tubular shape extending upward from the inflow port 31*a* as shown in FIG. 2.

As shown in FIG. 2, among the plates 12 to 14, the uppermost plate 12 has a through hole at a center thereof. The through hole communicates with the upper reservoir 31 through the outflow port 31*b*, and serves as a falling passage 12*a*. The lowermost plate 14 has through holes that communicate with ink supply ports 101 (see FIG. 5) and serve as ten supply passages 14*a*. The ink supply ports 101 are formed in a later-described passage unit 9 included in the head main body 2. The middle plate 13 has a hole serving as a branch passage 13*a* that makes communication between the falling passage 12*a* and the ten supply passages 14*a*. The falling passage 12*a*, the branch passage 13*a*, and the supply passages 14*a* constitute the lower reservoir 41.

Next, a description will be given to how ink flows in the reservoir unit 3 when ink is supplied. In FIG. 2, black arrows indicate ink flow in the reservoir unit 3.

As indicated by the black arrows in FIG. 2, ink, which has flown through the reservoir-side joint 30 and the inflow port 31*a* to the upper reservoir 31, once flows downward and then flows along the extending direction of the passage component 11. At this time, ink flowing along the extending direction of the passage component 11 moves upward while passing through a filter 32. At the center of the passage component 11, the ink flows downward again, and flows out through the outflow port 31*b* into the falling passage 12*a* of the lower reservoir 41. In the lower reservoir 41, the ink having flown out through the outflow port 31*b* of the upper reservoir 31 flows through the falling passage 12*a* into the branch passage 13*a*. The ink having flown into the branch passage 13*a* reaches the respective supply passages 14*a*, and is supplied to the passage unit 9 (see FIG. 5) through the ink supply ports 101.

Figure 4A:
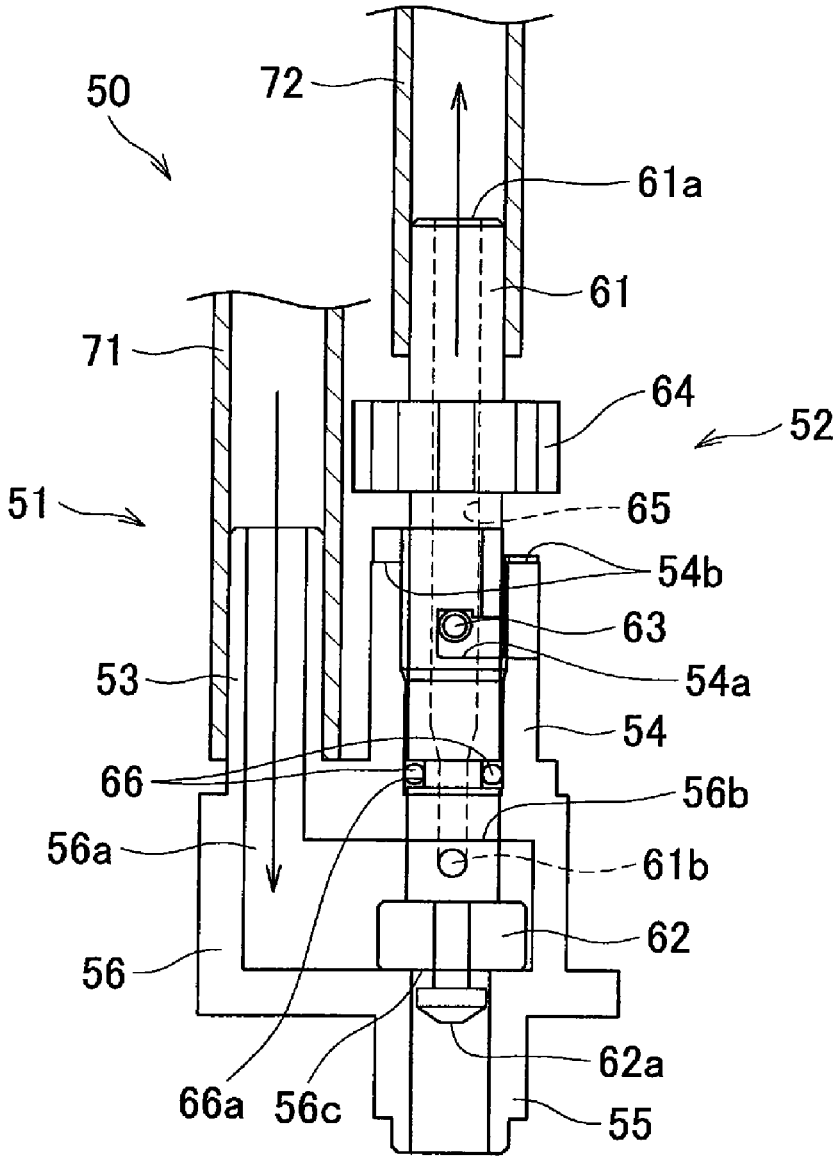
FIG. 4A is a one-side view of a valve shown in FIG. 1 being in a discharge state.
Figure 4B:
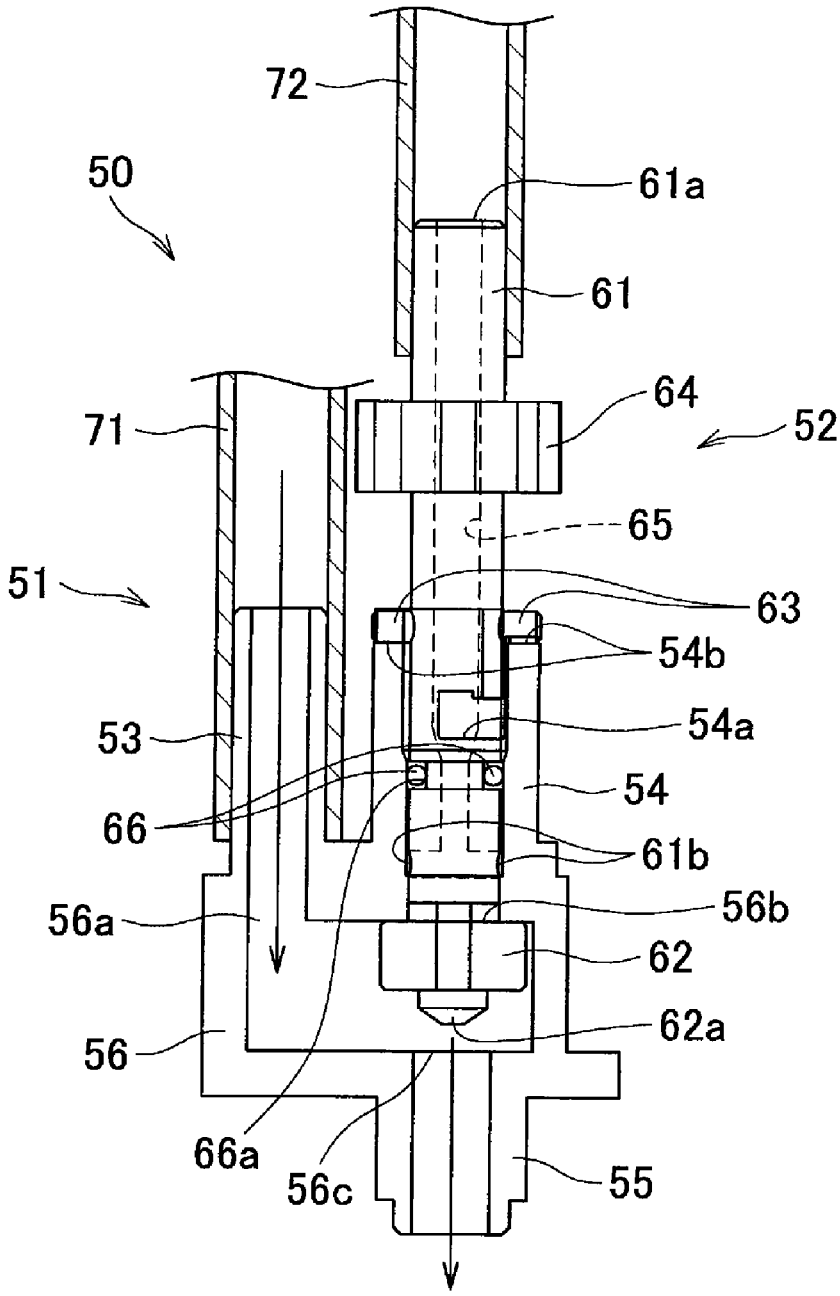
FIG. 4B is a one-side view of the valve shown in FIG. 1 being in a supply state.

Next, the valve 50 will be described with reference to FIGS. 4A and 4B. FIGS. 4A and 4B are one-side views of the valve 50. In FIGS. 4A and 4B, for the purpose of explanatory convenience, an internal structure of a valve main body 51 is illustrated with solid lines through it should actually be illustrated with broken lines. However, only an internal passage 65 formed inside a valve head 52 is illustrated with broken lines.

As shown in FIGS. 4A and 4B, the valve 50 includes a valve main body 51 and a valve head 52 as an opening/closing mechanism. The valve main body 51 has a valve chamber 56 of substantially rectangular parallelpiped shape, an ink tube joint 53 as a supply passage and a support wall 54 that are formed on an upper face of the valve chamber 56, and a valve-side joint 55 that is formed on a lower face of the valve chamber 56. Each of the ink tube joint 53 as a supply passage and the valve-side joint 55 has a tubular shape. The support wall 54 has a substantially tubular shape. Any of the ink tube joint 53 as a supply passage, the support wall 54, and the valve-side joint 55 extends in a vertical direction, which means a direction perpendicular to the ink ejection face 108*a*.

An internal space is formed inside the valve chamber 56. The internal space of the valve chamber 56 communicates with the ink tube joint 53 through an ink supply port 56*a*, with the support wall 54 through an outside discharge port 56*b* as a first discharge port, and with the valve-side joint 55 through a reservoir discharge port 56*c* as a second discharge port. Opening planes of the ink supply port 56*a*, the outside discharge port 56*b*, and the reservoir discharge port 56*c* are in parallel to the ink ejection face 108*a*. In addition, the outside discharge port 56*b* and the reservoir discharge port 56*c* are disposed in opposition to each other. As will be described later, the outside discharge port 56*b* and the reservoir discharge port 56*c* discharge ink in opposite directions.

Connected to the ink tube joint 53 is an ink tube 71 through which ink is supplied to the ink-jet head 1. An outer diameter of the ink tube joint 53 is substantially the same as an inner diameter of the ink tube 71. The ink tube joint 53 is inserted into the ink tube 71, so that they are connected to each other. At this time, an internal space of the ink tube 71 and an internal space of the ink tube joint 53 communicate with each other.

The support wall 54 slidably supports a support member 61 of the valve head 52. Two notches 54*a* as a first notch are formed in a peripheral wall of the support wall 54. The notch 54*a* extends downward from an upper end of the support wall 54 and, at its lower end portion, curves along a circumference of the peripheral wall. Shapes of the two notches 54*a* are symmetrical with respect to a central axis of the support wall 54. Only one of the two notches 54*a* appears in FIGS. 4A and 4B. In FIGS. 4A and 4B, the notch 54*a* extends in an up-and-down direction at a right-side portion of the peripheral wall of the support wall 54, and curves at its lower end portion so that it extends to a center.

In addition, two notches 54*b* as a second notch are formed at an upper end portion of the peripheral wall of the support wall 54. Positions of the two notches 54*b* are different from positions of the two notches 54*a*. The peripheral wall is notched along its circumference, so that the two notches 54*b* are formed. Like the two notches 54*a*, the two notches 54*b* have shapes symmetrical with respect to a central axis of the support wall 54. One ends of the two notches 54*b* with respect to the circumferential direction of the peripheral wall are connected to portions of the respective two notches 54*a* extending in the up-and-down direction. That is, in FIGS. 4A and 4B, the right notch 54*b* has its one end connected to the shown notch 54*a*, and extends toward a far side in the drawing. The left notch 54*b* has its one end connected to the not-shown notch 54*a*, and extends toward a near side in the drawing. Two protrusions 63 of the valve head 52, which will be described later, are engaged with the respective notches 54*a* and 54*b*.

The valve-side joint 55 is connected to the reservoir-side joint 30 formed on an upper face of the reservoir unit 3. An inner diameter of the valve-side joint 55 is substantially the same as an outer diameter of the reservoir-side joint 30. The reservoir-side joint 30 is inserted into the valve-side joint 55, so that they are connected to each other. Thus, an internal space of the valve-side joint 55 and an internal space of the reservoir-side joint 30 communicate with each other, and therefore the valve-side joint 55 communicates with the upper reservoir 31 through the reservoir-side joint 30 and the inflow port 31*a* (see FIGS. 1 and 2).

The valve head 52 has a support member 61 and a seal member 62. The support member 61 has a substantially columnar shape extending in one direction. The seal member 62 has a cylindrical shape and is attached to an end portion, i.e., a lower end portion in FIGS. 4A and 4B, of the support member 61. The support member 61 has a pair of protrusions 63 in a middle portion of its peripheral wall with respect to a longitudinal direction. Positions at which the respective protrusions 63 protrude are symmetrical with respect to a central axis of the support member 61. A disc-like grip 64 is formed between an upper end and the protrusions 63 of the support member 61. In addition, an internal passage 65 is formed inside the support member 61. The internal passage 65 extends downward from an outflow opening 61*a* that is formed at the upper end of the support member 61. Besides, the internal passage 65 is connected to a pair of inflow openings 61*b* formed on the peripheral wall. The pair of inflow openings 61*b* are formed between the seal member 62 and the protrusions 63, and positioned symmetrically with respect to the central axis of the support member 61. In other words, with respect to an extending direction of the support member 61, the outflow opening 61*a* is more distant from the seal member 62 than the inflow openings 61*b* are, and the internal passage 65 is formed between the outflow opening 61*a* and the inflow openings 61*b*. An outer diameter of the support member 61 is substantially the same as an inner diameter of the support wall 54.

In this embodiment, between the inflow openings 61*b* and the protrusions 63 of the support member 61, an annular groove 66*a* is formed over an entire circumference of the peripheral wall. The groove 66*a* is always opposed to the support wall 54 regardless of a position of the seal member 62. Another annular seal member 66 such as an O-ring is mounted in the groove 66*a*.

Both of the seal members 62 and 66 are elastic bodies such as rubber. A portion of the support member 61 near its lower end is thinner than the other portion of the support member 61, and the seal member 62 is fitted in the thinner portion. An anti-falling stopper 62*a* is provided at a lower end portion of the support member 61, thereby preventing the seal member 62 from falling out.

The valve head 52 is slidably supported on the support wall 54 in such a manner that the support member 61 penetrates through the outside discharge port 56*b* and besides the seal member 62 is positioned within the valve chamber 56. The seal member 62 is positioned between the outside discharge port 56*b* and the reservoir discharge port 56*c*. By operating the grip 64 in this condition, the valve head 52 can freely slide in a circumferential direction of the support member 61 and in the up-and-down direction, which means a direction perpendicular to the opening planes of the outside discharge port 56*b* and the reservoir discharge port 56*c*. The protrusions 63 of the support member 61 are accordingly movable along the notches 54*a* and 54*b*.

Next, an operation of the valve 50 will be described. When the protrusions 63 of the support member 61 are engaged with lower end portions of the notches 54*a* of the support wall 54 as shown in FIG. 4A, the sealing member 62 within the valve chamber 56 takes a position (first position) at which it opens the outside discharge port 56*b* while sealing the reservoir discharge port 56*c*. At this time, the inflow openings 61*b* of the support member 61 locate within the valve chamber 56, and thus the internal passage 65 of the support member 61 communicates with the valve chamber 56 through the outside discharge port 56*b*. In other words, a passage between the ink supply port 56*a* and the outside discharge port 56*b* is formed, while access between the ink supply port 56*a* and the reservoir discharge port 56*c* is blocked. Hereinafter, this condition will be referred to as a discharge state. At this time, the seal member 66 seals up between the support member 61 and the support wall 54, so that the ink supply port 56*a* communicates only with a portion of the outside discharge port 56 meeting the internal passage 65.

By operating the grip 64, the protrusion 63 engaged with the lower end of the notch 54*a* as shown in FIG. 4A is moved along a shape of the notch 54*a*, and engaged with the notch 54*b* as shown in FIG. 4B. That is, the valve head 52 rotates rightward along the circumferential direction of the support member 61, and then moves upward until the protrusion 63 is positioned at the upper end of the support member 61. Then, the valve head 52 again rotates rightward along the circumferential direction of the support member 61. At this time, the inflow openings 61*b* locating within the valve chamber 56 move through the outside discharge opening 56*b* into the support wall 54.

When the protrusions 63 of the support member 61 are engaged with the notches 54*b* of the support wall 54 as shown in FIG. 4B, the sealing member 62 within the valve chamber 56 takes a position (second position) at which it seals the outside discharge port 56*b* while opening the reservoir discharge port 56*c*. At this time, the inflow openings 61*b* of the support member 61 get out of the valve chamber 56 and come within the support wall 54. Thus, access between the valve chamber 56 and the internal passage 65 of the support member 61 is blocked. In other words, a passage between the ink supply port 56*a* and the reservoir discharge port 56*c* is formed, while access between the ink supply port 56*a* and the outside discharge port 56*b* is blocked. Hereinafter, this condition will be referred to as a supply state.

As described above, by moving the valve head 52 in the up-and-down direction, the valve 50 can selectively take the discharge state and the supply state. In the discharge state, a passage between the ink supply port 56*a* and the outside discharge port 56*b* is formed while access between the ink supply port 56*a* and the reservoir discharge port 56*c* is blocked. In the supply state, a passage between the ink supply port 56*a* and the reservoir discharge port 56*c* is formed while access between the ink supply port 56*a* and the outside discharge port 56*c* is blocked.

Figure 5:
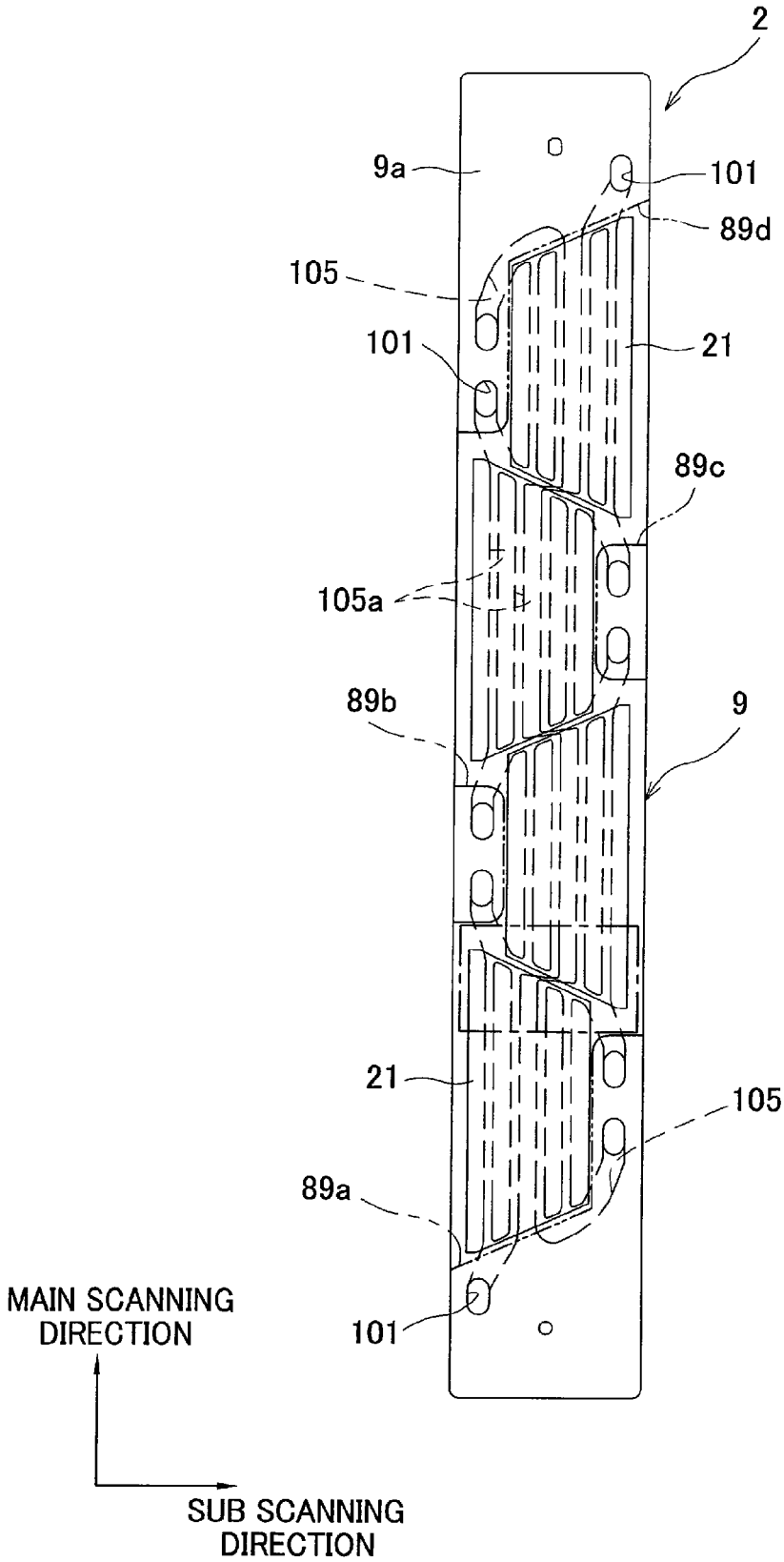
FIG. 5 is a plan view of a head main body shown in FIG. 2.
Figure 6:
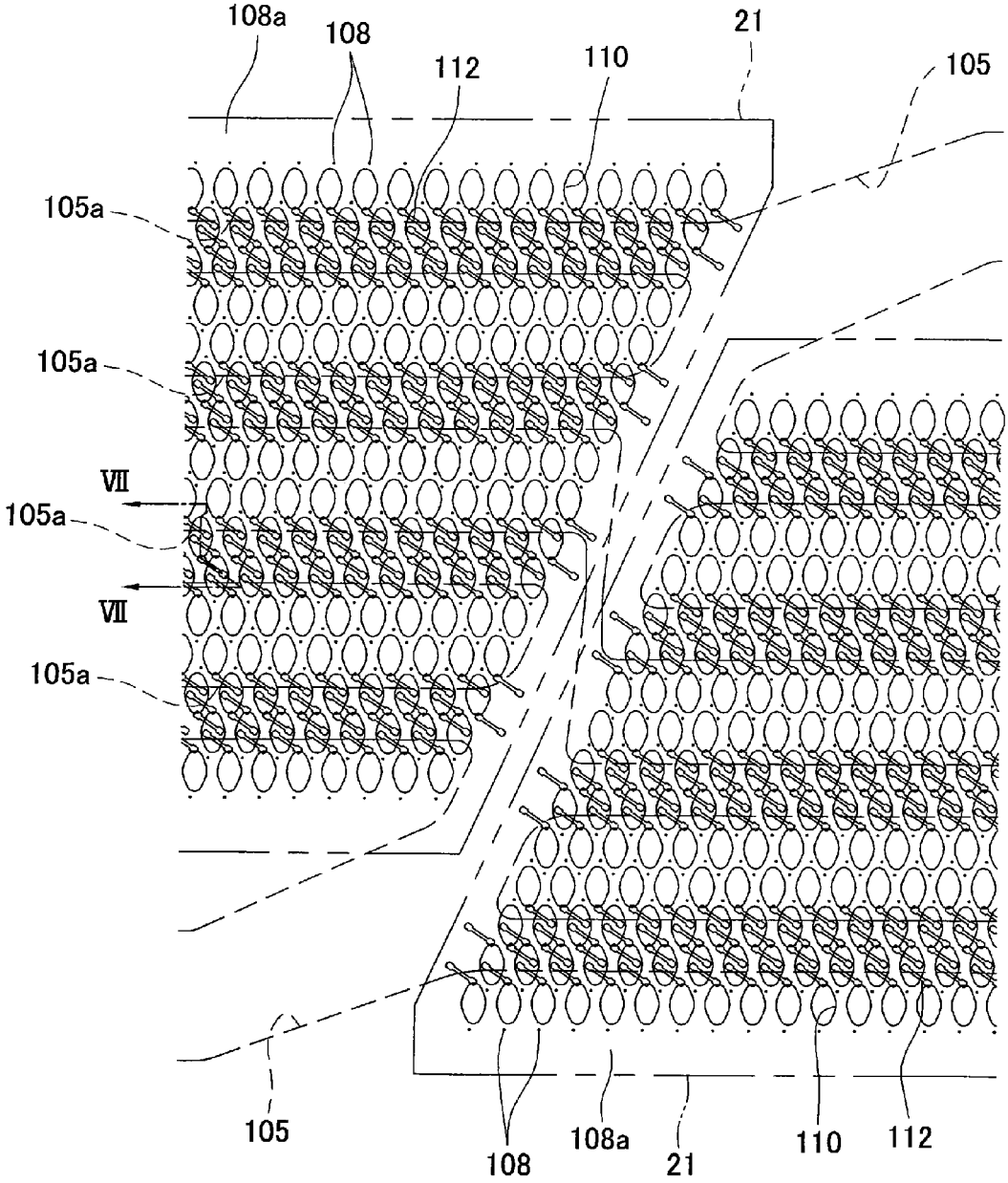
FIG. 6 shows on an enlarged scale a region enclosed with an alternate long and short dash line in FIG. 5.
Figure 7:
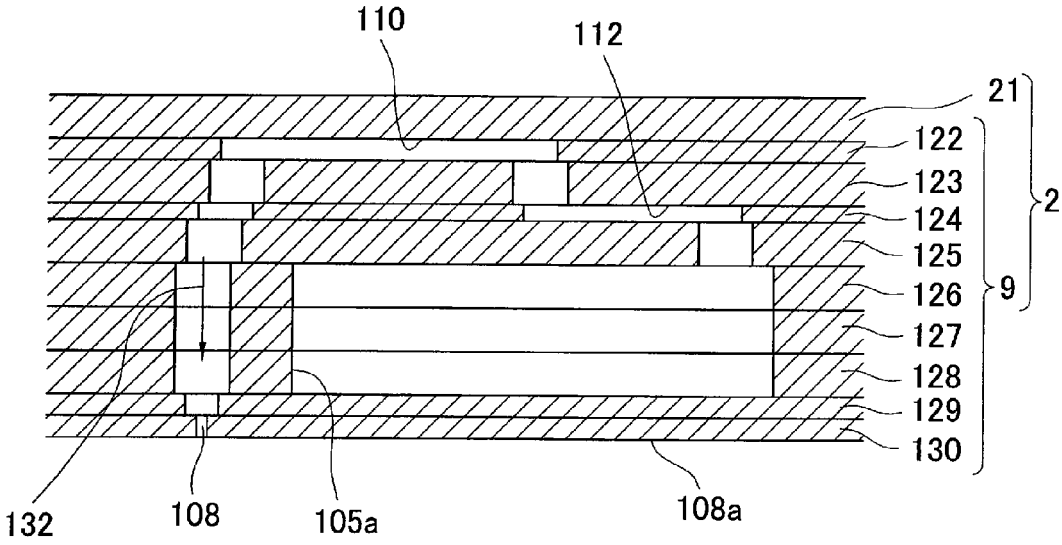
FIG. 7 is a sectional view taken along line VII-VII shown in FIG. 6.
Figure 8A:
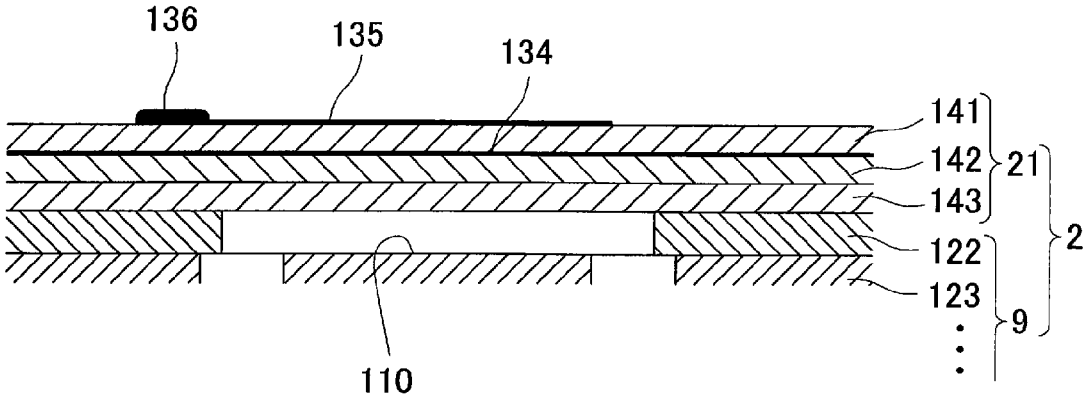
FIG. 8A shows on an enlarged scale an actuator unit shown in FIG. 6.
Figure 8B:
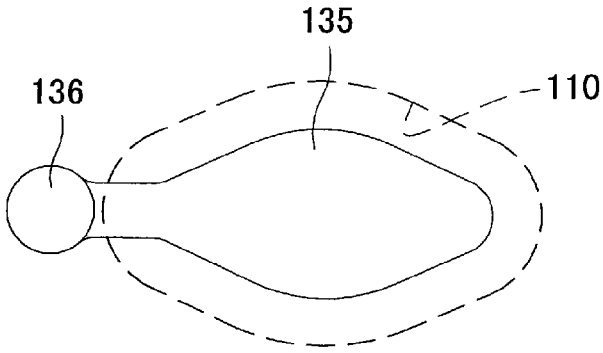
FIG. 8B is a plan view of an individual electrode that is disposed on a surface of the actuator unit in FIG. 8A.

Next, the head main body 2 will be described with reference to FIGS. 5 to 8B. FIG. 5 is a plan view of the head main body 2. FIG. 6 shows on an enlarged scale a region enclosed with an alternate long and short dash line in FIG. 5. In FIG. 6, for the purpose of explanatory convenience, pressure chambers 110, apertures 112, and nozzles 108 are illustrated with solid lines though they actually should be illustrated with broken lines because they locate under the actuator units 21. FIG. 7 is a partial sectional view taken along line VII-VII shown in FIG. 6. FIG. 8A is a sectional view of the actuator unit 21 on an enlarged scale. FIG. 8B is a plan view of an individual electrode that is disposed on a surface of the actuator unit 21 in FIG. 8A.

As shown in FIG. 5, the head main body 2 includes a passage unit 9 and four actuator units 21 bonded to an upper face 9*a* of the passage unit 9. Each of the actuator units 21 has a trapezoidal shape in a plan view.

The passage unit 9 has a rectangular parallelpiped shape having substantially the same planar shape as that of the plate 14 of the reservoir unit 3. A total of ten ink supply ports 101 are opened on the upper face 9*a* of the passage unit 9. The ten ink supply ports 101 correspond to the supply passages 14*a* of the reservoir unit 3 (see FIG. 2). Manifold channels 105 that communicate with the ink supply ports 101, and sub manifold channels 105*a* that are branched from the manifold channels 105 are formed within the passage unit 9. As shown in FIGS. 6 and 7, in a region of a lower face of the passage unit 9 opposed to each actuator unit 21, an ink ejection face 108*a* in which many nozzles 108 are arranged in a matrix is formed. In a region of the upper face 9*a* of the passage unit 9 opposed to each actuator unit 21, many pressure chambers 110 are arranged in a matrix.

In this embodiment, as shown in FIG. 6, sixteen pressure chamber rows, in each of which pressure chambers 110 are arranged at regular intervals in a longitudinal direction of the passage unit 9, which means a horizontal direction in FIG. 6, are disposed in parallel to each other in a widthwise direction of the passage unit 9, which means an up-and-down direction in FIG. 6. The number of pressure chambers 110 included in each pressure chamber row is, in conformity with an outer configuration of the actuator unit 21, gradually reduced from a longer side to a shorter side of the actuator unit 21. As a whole, an image can be formed at a resolution of 600 dpi.

As shown in FIG. 7, the passage unit 9 is made up of nine plates made of a metal such as a stainless steel. The nine plates are, from a top, a cavity plate 122, a base plate 123, an aperture plate 124, a supply plate 125, manifold plates 126, 127, 128, a cover plate 129, and a nozzle plate 130. Each of the plates 122 to 130 has a rectangular plane elongated in the main scanning direction.

Formed in the cavity plate 122 are many substantially rhombic through holes that correspond to pressure chambers 110. Formed in the aperture plate 124 are apertures 112 that communicate with the respective pressure chambers 110 through connection holes formed in the base plate 123. Formed in the manifold plates 126, 127, and 128 are through holes that are, when the plates are put in layers, combined with each other to form manifold channels 105 and sub manifold channels 105*a*. The sub manifold channels 105*a* communicate with the apertures 112 through connection holes formed in the supply plate 125. Formed in the nozzle plate 130 are holes that correspond to nozzles 108 each for each pressure chamber 110. In addition, not-shown connection holes for connecting the ink supply ports 101 to the manifold channels 105 are formed in the plates 122 to 125. Besides, connection holes for connecting the pressure chambers 110 to the respective nozzles 108 are formed in the plates 123 to 129.

The plates 122 to 130 are put in layers so as to form manifold channels 105, sub manifold channels 105*a*, and many individual ink passages 132 each extending from an outlet of a sub manifold channel 105*a* through an aperture 112, which functions as a throttle, and a pressure chamber 110 to a nozzle 108. Thereby, ink supplied from the reservoir unit 3 through the ink supply ports 101 into the passage unit 9 is divided from the manifold channels 105 into the sub manifold channels 105*a*, and flows into the respective individual ink passages 132 and reaches the nozzles 108.

The actuator unit 21 will be described. As shown in FIG. 5, the four actuator unit 21 each having a trapezoidal shape in a plan view are disposed in a zigzag pattern, away from the ink supply ports 101 which open on the upper face 9*a* of the passage unit 9. Parallel opposed sides of each actuator unit 21 are along the longitudinal direction of the passage unit 9, and oblique sides of every neighboring actuator units 21 overlap each other with respect to the widthwise direction of the passage unit 9, which means the sub scanning direction.

As shown in FIG. 8A, the actuator unit 21 is made up of three piezoelectric sheets 141, 142, and 143 each having a thickness of approximately 15 μm. The three piezoelectric sheets 141, 142, and 143 are made of a lead zirconate titanate (PZT)-base ceramic material having ferroelectricity. The piezoelectric sheets 141 to 143 are disposed so as to extend over many pressure chambers 110 that correspond to one ink ejection face 108*a*.

On the uppermost piezoelectric sheet 141, an individual electrode 135 is formed at a position opposed to each pressure chamber 110. A common electrode 134 having a thickness of approximately 2 μm and kept at the ground potential is interposed between the uppermost piezoelectric sheet 141 and the piezoelectric sheet 142 disposed under the uppermost piezoelectric sheet 141. The common electrode 34 is interposed over an entire face of the sheet. Both of the individual electrode 135 and the common electrode 134 are made of a metal material such as an Ag—Pd-base one. There is no electrode between the piezoelectric sheets 142 and 143.

The individual electrode 135 has a thickness of approximately 1 μm. In a plan view, as shown in FIG. 8B, the individual electrode 135 has a substantially rhombic shape similar to a shape of the pressure chamber 110. One acute portion of the substantially rhombic individual electrode 135 extends out, and a circular land 136 is provided on an end of this extending-out portion. The land 136 has a diameter of approximately 160 μm, and is electrically connected to the individual electrode 135. The land 136 is made for example of gold including glass frits. Each land 136 is connected to a not-shown driver IC through a not-shown FPC (Flexible Printed Circuit). Accordingly, a potential of each individual electrode 135 can be controlled selectively.

Here, a driving mode of the actuator unit 21 will be described. The piezoelectric sheet 141 is polarized in its thickness direction. When an individual electrode 135 is set at a potential different from a potential of the common electrode 134, an electric field in a polarization direction is applied to a portion of the piezoelectric sheet 141 sandwiched between the individual electrode 135 and the common electrode 134. As a result, the portion of the piezoelectric sheet 141 having the electric field applied thereto acts as an active portion which is distorted by a piezoelectric effect. The other two piezoelectric sheets 142 and 143 are inactive layers not including a region sandwiched between the individual electrode 135 and the common electrode 134, and therefore cannot deform by themselves. That is, the actuator unit 21 is of so-called unimorph type made up of a layer including an active portion and inactive layers.

As shown in FIG. 8A, the piezoelectric sheets 141 to 143 are fixed on an upper face of the cavity plate 122 that partitions the pressure chambers 110. Therefore, when difference occurs between plane-direction distortion of a portion of the piezoelectric sheet 141 to which the electric field is applied and plane-direction distortion of the lower piezoelectric sheets 142 and 143, the piezoelectric sheets 141 to 143 as a whole deform protrudingly toward a pressure chamber 110, i.e. that is cause unimorph deformation. This reduces the volume of the pressure chamber 110. Pressure inside the pressure chamber 110 rises accordingly, and ink is pushed out of the pressure chamber 110 to a nozzle 108 so that an ink droplet is ejected from the nozzle 108. Thereafter, when the individual electrode 135 is set at the same potential as the potential of the common electrode 134, the piezoelectric sheets 141 to 143 restore the original flat shape, and the volume of the pressure chamber 110 also returns to the original one. Ink is accordingly introduced from the manifold channel 105 into the pressure chamber 110, and thus the pressure chamber 110 is charged with ink again.

Next, procedures for charging ink into the ink-jet head 1 will be described. In order to charge ink into the ink-jet head 1, first, the grip 64 is operated so as to bring the valve 50 into the discharge state in which a passage is formed between the ink supply port 56*a* and the outside discharge port 56*b* and in addition access between the ink supply port 56*a* and the reservoir discharge port 56*c* is blocked, as shown in FIG. 4A. At this time, the seal member 62 closes the reservoir discharge port 56*c*. Then, one end of the ink tube 71 is connected to the ink tube joint 53 of the valve 50. The other end of the ink tube 71 is connected through a pump to a not-shown ink tank. By driving the pump, ink in the ink tank is forcibly sent out to the ink tube 71. One end of a discharge tube 72 is connected to an end portion of the support member 61 of the valve 50 at which the outflow opening 61*a* is formed. The other end of the discharge tube 72 is connected to a not-shown waste ink tank.

In this condition, the pump is driven to start sending out ink. Ink is thereby supplied from the ink tube 71 through the ink tube joint 53 and the ink supply port 56*a* to the valve chamber 56. Ink supplied to the valve chamber 56 flows through the inflow openings 61*b* of the support member 61 into the internal passage 65. The ink then goes through the outside discharge port 56*b*, and is discharged from the outflow opening 61*a* through the discharge tube 72 to the waste ink tank. Consequently, air contained in the pump, the ink tube 71, and the valve chamber 56 is discharged to outside together with the ink. Since access between the ink supply port 56*a* and the reservoir discharge port 56*c* is blocked, air contained in the pump, the ink tube 71, and the valve chamber 56 does not go through the reservoir discharge port 56*c* and the valve-side joint 55 into the inflow port 31*a* and the upper reservoir 31 of the reservoir unit 3. Since the seal member 66 seals up a narrow gap between the support member 61 and the support wall 54 as described above, ink having flown into the valve 50 does not flow out through the gap. Therefore, an apparatus can be prevented from being stained with ink.

After air contained in the pump, the ink tube 71, and the valve chamber 56 is fully discharged to outside and ink is charged into them, the grip 64 is operated so as to bring the valve 50 into the supply state in which a passage is formed between the ink supply port 56*a* and the reservoir discharge port 56*c* and in addition access between the ink supply port 56*a* and the outside discharge port 56*b* is blocked, as shown in FIG. 4B. At this time, the seal member 62 closes the outside discharge port 56*b*. Thus, ink supplied through the ink tube joint 53 and the ink supply port 56*a* into the valve chamber 56 is supplied through the reservoir discharge port 56*c* and the valve-side joint 55 into the inflow port 31*a* and the upper reservoir 31 of the reservoir unit 3. Ink thus supplied to the upper reservoir 31 is charged into the above-described ink passages in the ink-jet head. At this time, ink supplied to the valve chamber 56 is not discharged to outside through the outside discharge port 56*b* and the outflow opening 61*a* of the internal passage 65, because access between the ink supply port 56*a* and the outside discharge port 56*b* is blocked.

In a case where the ink-jet head 1 alone is dispatched, the ink-jet head 1 is sometimes charged not with ink but with a preservation solution including a metal-rust inhibitor, an anti-drying agent, and a surfactant. In this case, the above-described charging operation is performed for charging the preservation solution, and then the grip 64 is operated again so as to bring the valve 50 into the discharge state. Thus, the ink passages of the ink-jet head 1 are sealed. Then, the ink tube 71 is pulled away from the ink tube joint 53, and the discharge tube 72 is pulled away from the support member 61.

Like this, in both of a case where the ink-jet head 1 itself is dispatched and transported and a case where the ink-jet head 1 is incorporated into an apparatus and subjected to a maintenance operation, the valve 50 prevents air from entering the ink-jet head 1 while keeping the ink-jet head 1 filled with liquid. Therefore, wasteful ink consumption, which occurs before the ink-jet head 1 performs printing, can be reduced. In addition, an apparatus can be brought into a printable state in a short time.

In the above-described embodiment, by bringing the valve 50 into the discharge state, air contained in the pump, the ink tube 71, and the valve chamber 56 does not flow into the ink passages of the ink-jet head 1 but is discharged to outside. Therefore, when the valve 50 gets in the supply state, air contained in the pump, the ink tube 71, and the valve chamber 56 does not flow into the ink passages of the ink-jet head 1. This can prevent fine individual ink passages 132 from being blocked by air bubbles.

In the valve 50, the discharge state and the supply state can be switched from one to the other by reciprocating the seal member 62 between the outside discharge port 56*b* and the reservoir discharge port 56*c*. Therefore, the valve 50 can be realized with a simple structure. This can realize reduced costs of the valve 50.

In addition, the seal member 62 is disposed near the end of the support member 61 of the valve head 52, and the support member 61 is supported on the support wall 54 so as to be slidable in the up-and-down direction. Accordingly, the discharge state and the supply state can be switched from one to the other through a simple operation of moving the valve head 52 in the up-and-down direction.

Moreover, when the protrusions 63 of the support member 61 are engaged with the notches 54*a* formed in the support wall 54, the valve 50 is in the discharge state, while when the protrusions 63 are engaged with the notches 54*b* formed in the support wall 54, the valve 50 is in the supply state. This can prevent occurrence of an erroneous operation of the valve 50 while ink or a preservation solution is being charged into the ink-jet head 1.

Since the ink tube joint 53 and the support member 61 extend in the direction perpendicular to the ink ejection face 108*a*, the ink tube 71 and the discharge tube 72 can easily be inserted and pulled.

The upper reservoir 31 is formed only in the portion of the passage component 11 between the center and the one end with respect to the extending direction of the passage component 11. Therefore, another independent upper reservoir 31 can be formed in a portion of the passage component 11 between the center and the other end with respect to the extending direction of the passage component 11. This enables, with a simple design change, the ink-jet head to handle two colors.

Since the valve 50 is disposed near one end portion of the reservoir unit 3, the ink tube 71 and the discharge tube 72 connected to the valve 50 are not laid over the ink-jet head 1. Therefore, a control board and the like can be placed on the ink-jet head 1.

Next, a modification of this embodiment will be described. In this embodiment, the passage component 11 and the valve main body 51 are separate members. However, it may also be possible that the passage component 11 and the valve main body 51 are formed in one piece (see FIG. 1). This can realize reduced costs of the ink-jet head 1.

Figure 9:
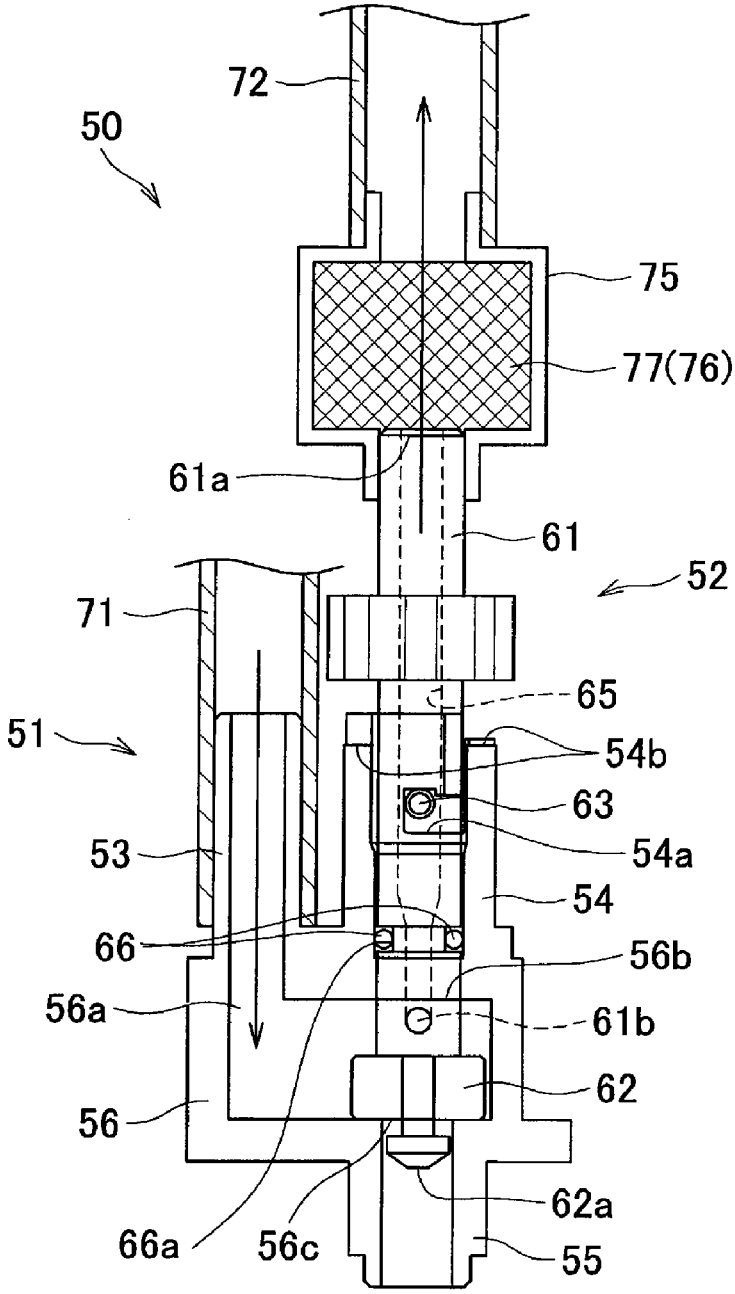
FIG. 9 shows a modification of the embodiment.

In this embodiment, the discharge tube 72 is connected directly to the end of the support member 61 of the valve 50 at which the outflow opening 61*a* is formed. However, as shown in FIG. 9, a discharge passage member 75 may be disposed between the discharge tube 72 and the end of the support member 61 having the outflow opening 61*a* formed thereat. The discharge passage member 75 has a pipe shape in which a discharge passage 76 is formed. A sponge 77 as a porous member is disposed in the discharge passage 76. In this case, while the valve 50 is in the discharge state, ink and air contained in the discharge passage 76 do not easily flow backward, because meniscuses are formed at pores of the sponge 77 disposed in the discharge passage 76.

In the above-described embodiment, the outside discharge port 56*b* and the reservoir discharge port 56*c* of the valve chamber 56 are disposed in opposition to each other, so that they discharge ink in opposite directions. However, the outside discharge port and the reservoir discharge port may be provided at arbitrary positions.

In the above-described embodiment, the discharge state and the supply state can be switched from one to the other by reciprocating the seal member 62 between the outside discharge port 56*b* and the reservoir discharge port 56*c*. However, actions of the seal member are not limited thereto. For example, it may also be possible that, in a valve chamber having therein an internal space of cylindrical shape, an outside discharge port and a reservoir discharge port are formed on a surface of an inner peripheral wall of the valve chamber. In this case, the seal member slides along the inner peripheral wall of the valve chamber to thereby open or close the outside discharge port and the reservoir discharge port, so that a discharge state and a supply state are switched from one to the other.

In the above-described embodiment, the notches 54*a* and 54*b* are formed in the support wall 54 and, in the discharge state and in the supply state, the protrusions 63 of the support member 61 are engaged with the notches 54*a* and 54*b*, respectively. However, the notches 54*a* and 54*b* may not be formed in the support wall 54. In such a case, it is preferable to provide another mechanism for holding the support member 61 in the respective states.

In the above-described embodiment, the ink tube joint 53 and the support member 61 extend in the direction perpendicular to the ink ejection face 108*a*, but they may extend in another direction.

In the above-described embodiment, the upper reservoir 31 is formed only in the portion of the passage component 11 between the center and the one end with respect to the extending direction of the passage component 11. However, the upper reservoir may be formed in an arbitrary region. For example, the upper reservoir may be formed in an entire region of the passage component.

In the above-described embodiment, the valve 50 is disposed near one end portion of the reservoir unit 3. However, the valve 50 may be disposed at an arbitrary position. For example, the valve 50 may be disposed at a center of the reservoir unit.

In the above-described embodiment, the valve 50 is applied to the ink-jet head 1. However, the valve 50 is applicable to other liquid-supply apparatuses.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An jet head comprising:

a passage unit that includes a common ink chamber and a plurality of individual ink passages each extending from the common ink chamber through a pressure chamber to a nozzle;

a reservoir unit that is fixed to the passage unit and includes an ink reservoir that communicates with the common ink chamber; and a discharge valve that includes a valve chamber and an opening/closing mechanism, the valve chamber having an ink supply port through which ink is supplied from outside, an outside discharge port through which ink is discharged to outside, and a reservoir discharge port through which ink is discharged to the ink reservoir, the opening/closing mechanism being able to selectively take either one of a state where a passage is formed between the ink supply port and the outside discharge port while access between the ink supply port and the reservoir discharge port is blocked and a state where a passage is formed between the ink supply port and the reservoir discharge port while access between the ink supply port and the outside discharge port is blocked, wherein, the outside discharge port and the reservoir discharge port are disposed in opposition to each other;

the opening/closing mechanism has an elastic member that is disposed in the valve chamber, and a support member that supports the elastic member and is able to selectively take a first position for making the elastic member seal the reservoir discharge port and open the outside discharge port and a second position for making the elastic member seal the outside discharge port and open the reservoir discharge port;

the discharge valve further has a support wall that supports the support member in such a manner that the support member penetrates through the outside discharge port and is slidable in a direction perpendicular to an opening plane of the outside discharge port;

the support member has an inflow opening that is formed between a position of the outside discharge port and a position at which the elastic member locates when the support member takes the first position, an outflow opening that is formed at a position more distant from the elastic member than the inflow opening is with respect to a sliding direction of the support member, and an internal passage that is formed between the inflow opening and the outflow opening; and when the support member takes the first position the inflow opening locates within the valve chamber and the outflow opening locates outside the valve chamber, while when the support member takes the second position the inflow opening and the outflow opening locate outside the valve chamber.

2. The ink jet head according to claim 1, wherein:

the support member has an annular groove that is formed on an outer wall of the support member over an entire circumference of the outer wall, and an annular seal member that is mounted in the groove; and the groove is formed in such a position that the groove is kept opposed to the support wall all the time while the support member is sliding between the first and second positions.

3. The ink jet head according to claim 1, wherein:

the support member further has a protrusion that protrudes from an outer wall of the support member; and the support wall has a first notch that is engageable with the protrusion when the support member takes the first position, and a second notch that is engageable with the protrusion when the support member takes the second position.

4. The ink jet head according to claim 1, wherein:

the discharge valve further has a supply passage at one end of which the ink supply port of the valve chamber is formed; and the supply passage and the internal passage of the support member extend in a direction perpendicular to a nozzle surface of the passage unit on which an opening of the nozzle is formed.

5. The ink jet head according to claim 1, wherein a porous member is disposed within a discharge passage having the outflow opening formed at its one end.

6. The ink jet head according to claim 1, wherein the valve chamber and at least a part of the reservoir unit are formed in one piece.

7. The ink jet head according to claim 1, wherein:

the reservoir unit extends in one direction; and the ink reservoir is formed only in a portion of the reservoir unit between a center and one end with respect to an extending direction of the reservoir unit.

8. The ink jet head according to claim 1, wherein:

the reservoir unit extends in one direction; and the discharge valve is disposed near one end portion of the reservoir unit with respect to an extending direction of the reservoir unit.

* * * * *